United States Patent [19]

Martin

[11] 4,090,615

[45] May 23, 1978

[54] COUPLER KNUCKLE ASSEMBLY

[75] Inventor: Albert Edward Martin, Lancaster, N.Y.

[73] Assignee: Dresser Industries, Inc., Dallas, Tex.

[21] Appl. No.: 723,853

[22] Filed: Sep. 17, 1976

[51] Int. Cl.[2] ..... B61G 3/00

[52] U.S. Cl. ..... 213/151; 213/100 R

[58] Field of Search ..... 213/151, 152, 100 R, 213/109, 115, 117, 119, 120, 121, 122, 123, 125–130, 131, 135, 136, 137, 138

[56] References Cited

U.S. PATENT DOCUMENTS

| | | | |
|---|---|---|---|
| 1,897,279 | 2/1933 | Richards | 213/126 |
| 3,856,156 | 12/1974 | Metzger | 213/151 |
| 3,972,421 | 8/1976 | De Penti | 213/127 |

*Primary Examiner*—Trygve M. Blix
*Assistant Examiner*—D. W. Keen
*Attorney, Agent, or Firm*—Raymond T. Majesko; John N. Hazelwood

[57] ABSTRACT

An improved coupler knuckle wherein the tail surface contour is formed by a mathematical function curve so that upon closing the portion of the surface, which interfaces with the lock becomes closer to the knuckle pivot thus providing increased clearance for the lock movement.

8 Claims, 5 Drawing Figures

FIG. 1
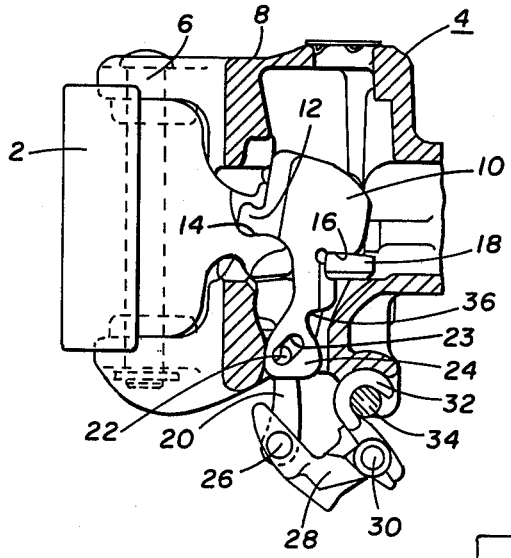
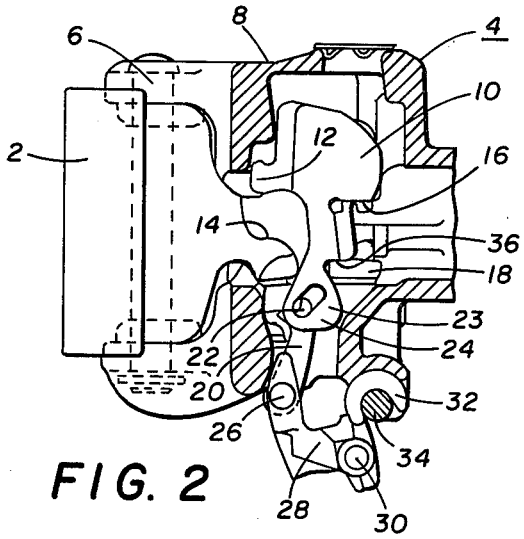
FIG. 2
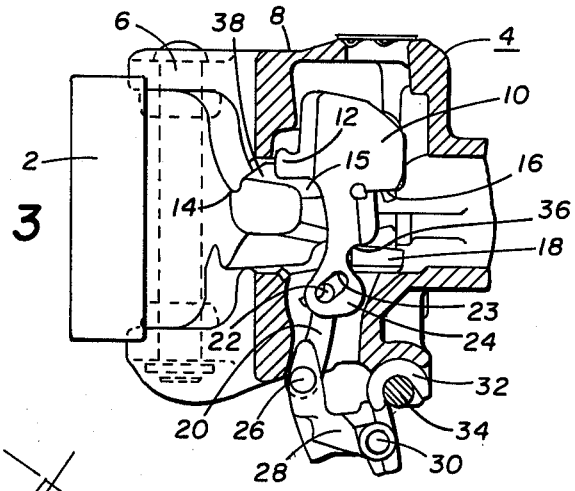
FIG. 3
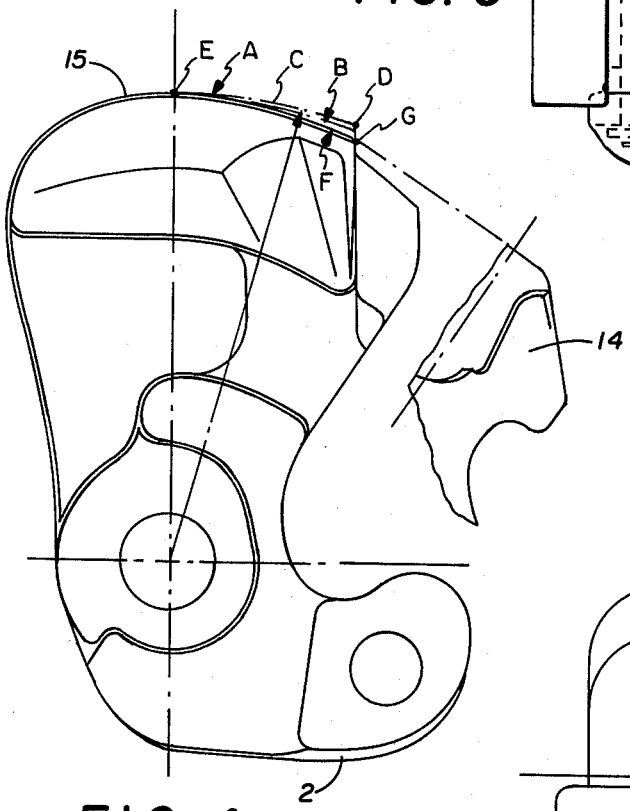
FIG. 4
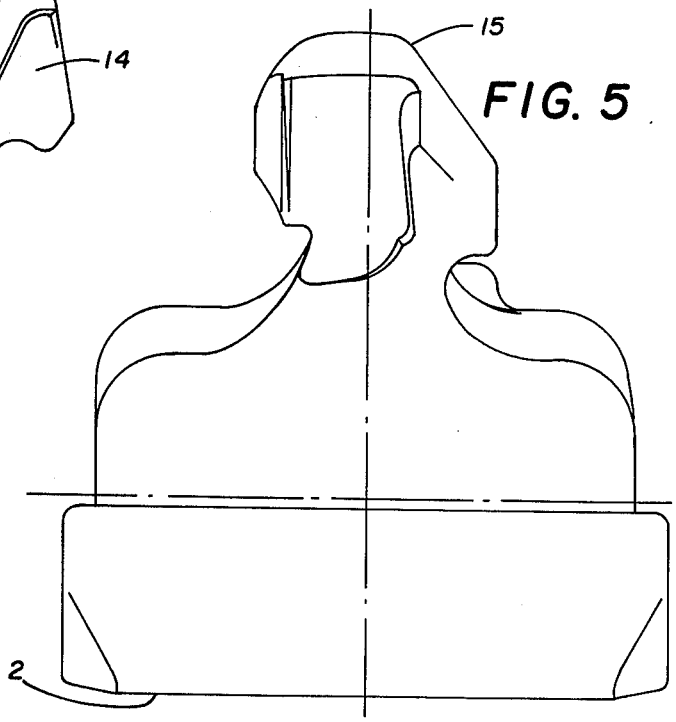
FIG. 5

COUPLER KNUCKLE ASSEMBLY

In couplers, such as the type E, there is a condition that exists when the knuckle is opened from the lock-set position, that upon closure, the lock will be thrown back into the lock-set position and fail to drop and lock the coupler. This action is unsafe and a cause for serious problems in railway cars. It is caused by an interaction between the lock throat, which is that portion of the leg immediately below the knuckle shelf seat and the knuckle tail wall. Other workers in the field studying the lock drop problem have proposed modifications to the lock guidance system, the operating mechanism, knuckle thrower location, etc. However, tests of these modifications show little or no improvement in the motions of the lock and failed to solve the problem because of continued failures of the lock to drop in place.

Accordingly, it is an object of the invention to eliminate an annoying condition in couplers where the lock fails to drop into the locked position when the knuckle is closed after being opened from the lock-set position.

Another object of the invention is to provide for a surface contour of the knuckle tail that becomes closer to the knuckle pin hole center as the distance from the longitudinal center line of the knuckle increases.

The foregoing and other objects and advantages of the invention will be understood by reference to the following specification and drawings in which:

FIG. 1 is a side elevation view partly in cross section of a standard AAR E coupler, the lock being shown in a locked position with the knuckle fully closed;

FIG. 2 is a view similar to FIG. 1 with the lock in the lock-set position prior to opening of the knuckle;

FIG. 3 is a view similar to FIG. 2 with the knuckle in an initial stage of its opening movement;

FIG. 4 is a top plan view of the coupler knuckle embodying the features of the present invention; and FIG. 5 is a side elevation view of the coupler knuckle of FIG. 4.

In accordance with the present invention and in attainment of the foregoing objects, there is provided a railway car coupler knuckle comprising a forward nose and a rearward tail containing a locking face. The knuckle has a vertical pivot pin hole intermediate the nose and tail for receiving a pin for connecting the knuckle to a coupler head. The knuckle tail has a curvature wherein the distance from the center of the pivot hole to the furthermost point on the tail approximately in alignment with the center line of the pin hole is at least equal to the distance from the center of the pivot pin hole to the furthermost point on the tail at the locking face.

Referring to the drawings, FIG. 1 illustrates a knuckle 2 of an American Association of Railroads (AAR) standard E coupler generally designated 4. The knuckle is pivotally connected by a pin 6 to a coupler head 8 and is shown in FIG. 1 in fully closed position with a lock 10 in locked position whereat the lock fulcrum 12 seats on a lock shelf 14 of the tail portion 15 of the knuckle and a substantially horizontal seat 16 of the lock is supported by a knuckle thrower 18 seat. The knuckle thrower is mounted for pivotal movement in the head on a vertical axis by means of a trunnion (not shown).

The lock 10 is actuated in the usual manner by a toggle 20 having a trunnion 22 received within the slot 23 in leg 24 of the lock. The toggle is pivotally connected at 26 to a connector 28 which is pivotally connected at 30 to a hook 32 pivotally mounted at 34 to the coupler head. An operating rod (not shown) is connected to the connector 28 in the usual manner to effect clockwise rotation (as shown in FIGS. 1 and 2) of the connector 28 and hook 32 for purposes hereinafter described.

FIG. 2 shows the lock in the lock-set position with a lock-set seat 36 of the lock supported by the thrower 18. It should be understood that the lock is actuated from the position of FIG. 1 to the position of FIG. 2 by clockwise rotation of the hook 32 and connector 28 so that the toggle trunnion slides upwardly to the top of the slot 23 pushing the lock upwardly and rotating the lock in a counter-clockwise direction to position the lock-set seat 36 above the thrower 18 whereupon the operating rod (not shown) is released, and its weight as well as the weight of the toggle 20, the connector 28 and the hook 32 cause them to drop along with the lock 10 to the position of FIG. 2. Under these conditions, the lock fulcrum 12 is aligned with the sloping surfaces 38 of the knuckle tail 15.

FIG. 3 illustrates the knuckle in the initial stage of its movement to an open position either by a manual operation or by an uncoupling movement of the head 8 or the head of the mated coupler (not shown) as is well known in the art. Continued movement of the knuckle to its fully open position causes the lock fulcrum 12 to slide upwardly along the sloping knuckle tail surface 38 whereby the lock rotates, by its own weight and the weight of the connected parts in a clockwise direction to a position whereat the lock-set seat 36 is entirely disposed forwardly of the knuckle throwers 18. Subsequent closing of the knuckle thus permits the lock to drop back to the position of FIG. 1.

When observing the operation of the present AAR standard E coupler, it was found that the knuckle tail surface contacts the lock throat surface during closure, i.e. after opening from the lock-set position, in such a manner as to throw the lock rearward and into the lock-set position where the lock rests on top of the knuckle thrower.

Referring to FIGS. 4 and 5, the tail surface A, which is the tail surface in the present standard E knuckle, is formed by an 8 $\frac{3}{8}$ inch radius that is offset horizontally from the pivot center by 9/16 inch. The result is that points on surface A increase in distance from the pivot center as their distance from the longitudinal center line increases. Arc B is struck from the pivot center. The distance of points C and D from Arc B can readily be observed. The effect of this difference is to force the lock rearwardly with an accelerating motion as the knuckle is closed. The pivot pin hole in the knuckle is circular; however, in the coupler body, the pivot pin hole is elongated in the longitudinal direction. The result is that further rearward motion to lock is added, because pressure of the knuckle during closing forces it toward the rear, taking up the clearances between the pin and elongated holes in the coupler body.

Accordingly, the knuckle tail was modified not only to provide a surface that is at any point equidistant (Arc B) from the knuckle pivot center, but is equidistant or less during operation of the knuckle when it shifts rearwardly to take up clearances in the pin holes as it closes (Line F). The invention may be charaterized by the mathematical formulations set forth in the Examples below.

EXAMPLE I

The curvature of the tail, originating at the center of the pivot pin hole, from the point on the tail E approximately in alignment with the longitudinal center line of the pin hole to the point on the tail G at the locking face is characterized as a function of the general form:

$Kx^2 + y^2 + m^2$ where
$x$ = lateral axis of pin hole
$y$ = longitudinal axis of pin hole
$m$ = constant and is approximately 8 $\frac{3}{8}$ inches
$K$ = constant and is between about 1 and 4.

EXAMPLE II

The distance $d$ from the center of the pivot pin hole to the furthermost point on the tail E to G at the locking face is characterized as:

$$d = \sqrt{m^2 + (1 - K)\,x^2}$$

where
$x$ = lateral axis of pin hole
$m$ = constant and is approximately 8 $\frac{3}{8}$ inches
$K$ = constant and is between about 1 and 4.

EXAMPLE III

Any point along the curvature on the knuckle tail E to G, is related to the pivot pin hole center by the polar equation:

$$r = \sqrt{(m^2/\,K\mathrm{Cos}^2\theta = \mathrm{Sin}^2\theta)}$$

where $r$ = distance from the pivot center to the tail
$\theta$ = angle of the ray r to the lateral center line of the knuckle
$m$ = constant and approximately 8 $\frac{3}{8}$inches
$K$ = constant and between about 1 and 4.

EXAMPLE IV

The curvature of the tail originating at the center of the pivot pin hole, from the point on the tail E approximately in alignment with the center line of the pin hole to the point on the tail G at the locking face is characterized as a function in the general form:

$$y = a = \sqrt{P\,(b-x)}$$

where
$y$ = longitudinal center line of the knuckle pin hole
$x$ = lateral center line of the knuckle pin hole
$a$ = constant and approximately 7.53
$b$ = constant and approximately 3.31
$P$ = constant and between about 0.2 and 1.

It is intended that the foregoing be construed as illustrative and not in limitation of the invention.

The embodiments of the invention in which an exclusive property or privilege is claimed are defined as follows:

1. A railway car coupler knuckle comprising a forward nose and a rearward tail containing a locking face, said knuckle having a vertical pivot pin hole intermediate the nose and tail for receiving a pin for connnecting the knuckle to a coupler head, the improvement comprising the knuckle tail having a curvature in which the radial distance from the pivot pin hole center to the rear edge gradually decreases as it approaches the locking face.

2. The knuckle of claim 1 in which the curvature of the tail, originating at the center of the pivot pin hole, from the point on the tail approximately in alignment with the center line of the pin hole to the point on the tail at the locking face is characterized as a function of the general form:

$$Kx^2 + y^2 = m^2$$

where
$x$ = lateral axis of pin hole
$y$ = longitudinal axis of pin hole
$m$ = constant
$K$ = at least about 1.

3. The knuckle of claim 2 in which K is equal to between about 1 and 4 and $m$ is approximately 8 $\frac{3}{8}$ inches.

4. The knuckle of claim 1 in which the distance d from the center of the pivot pin hole to the furthermost point on the tail at the locking face is characterized as:

$$d = \sqrt{m^2 + (1-K)x^2}$$

where
$x$ = lateral axis of pin hole
$m$ = approximately 8 $\frac{3}{8}$ inches
K = at least 1.

5. The knuckle of claim 4 in which K is equal to between about 1 and 4 where any point on the knuckle tail contour from the longitudinal centerline of the knuckle to the locking face is related to the pivot pin hole center.

6. The knuckle of claim 1 in which any point along said curvature on the knuckle tail is related to the pivot pin hole center by the polar equation:

$$r = \sqrt{(m^2/K\mathrm{Cos}^2\,\theta + \mathrm{Sin}^2\,\theta)}$$

where
$r$ = distance from the pivot center to the tail
$\theta$= angle of the ray $r$ to the lateral center line of the knuckle
$m$ = approximately 8 $\frac{3}{8}$inches
$K$ = between about 1 and 4.

7. The knuckle of claim 1, in which the curvature of the tail, originating at the center of the pivot pin hole, from the point on the tail approximately in alignment with the center line of the pin hole to the point on the tail at the locking face is characterized as a function in the general form:

$$y = a + \sqrt{P\,(b-x)}$$

where
$y$ = longitudinal center line of the knuckle pin hole.
$x$ = lateral center line of the knuckle pin hole
$a$ = approximately 7.53
$b$ = approximately 3.31
$P$ = between about 0.2 and 1.

8. In a coupler for a railway car having a coupler housing with a guard arm side and a knuckle side, a knuckle mounted on the knuckle side by a pivot pin disposed in a pivot pin hole and having a forward nose and a rearward tail containing a locking face for movement between and open and closed position, a lock chamber, a lock movable in the lock chamber between a release and lock position for releasing and locking the knuckle, the improvement comprising the knuckle tail having a curvature in which the radial distance from the pivot pin hole center to the rear edge gradually decreases as it approaches the locking face.

* * * * *